US009843095B2

(12) United States Patent
Ohguchi et al.

(10) Patent No.: US 9,843,095 B2
(45) Date of Patent: Dec. 12, 2017

(54) ANTENNA ELEMENT AND ANTENNA DEVICE

(71) Applicant: Sharp Kabushiki Kaisha, Osaka-shi, Osaka (JP)

(72) Inventors: Shuhhei Ohguchi, Osaka (JP); Hiroyuki Takebe, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 14/770,502

(22) PCT Filed: Jul. 1, 2014

(86) PCT No.: PCT/JP2014/067565
§ 371 (c)(1),
(2) Date: Aug. 26, 2015

(87) PCT Pub. No.: WO2015/005182
PCT Pub. Date: Jan. 15, 2015

(65) Prior Publication Data

US 2016/0020513 A1 Jan. 21, 2016

(30) Foreign Application Priority Data

Jul. 8, 2013 (JP) ..... 2013-142717

(51) Int. Cl.

| | |
|---|---|
| ***H01Q 1/12*** | (2006.01) |
| ***H01Q 1/50*** | (2006.01) |
| ***H01Q 1/24*** | (2006.01) |
| ***H01Q 9/42*** | (2006.01) |
| ***H01Q 1/27*** | (2006.01) |
| ***H01Q 1/36*** | (2006.01) |
| ***H01Q 1/46*** | (2006.01) |
| ***H01Q 21/30*** | (2006.01) |

(52) U.S. Cl.
CPC ..... *H01Q 1/50* (2013.01); *H01Q 1/243* (2013.01); *H01Q 1/273* (2013.01); *H01Q 1/36* (2013.01); *H01Q 1/46* (2013.01); *H01Q 9/42* (2013.01); *H01Q 21/30* (2013.01)

(58) Field of Classification Search
CPC ..... H01Q 1/50; H01Q 1/36; H01Q 1/273
USPC ..... 343/43, 718, 700 MS
See application file for complete search history.

(56) References Cited

U.S. PATENT DOCUMENTS

2007/0052595 A1 3/2007 Harano
2012/0188450 A1* 7/2012 Lynn ..... H04B 1/3805 348/552

FOREIGN PATENT DOCUMENTS

JP 2007-135233 A 5/2007
JP 2008-092265 A 4/2008
WO WO 2008/017844 * 8/2007

OTHER PUBLICATIONS

"Antenna Theory: A Review," Constantine A. Balanis, Proceedings of the IEEE, vol. 80, No. 1, section III.B, Jan. 1992.*

* cited by examiner

*Primary Examiner* — Hoang Nguyen
*Assistant Examiner* — Jae Kim
(74) *Attorney, Agent, or Firm* — Keating & Bennett, LLP

(57) ABSTRACT

An antenna element (10) includes: a feeding point (16); a connector (15) in which an external antenna is detachably engaged; a first partial element (11) connecting the feeding point (16) and the connector (15); and a second partial element (12) branching from the first partial element (11) and having an open end (12*a*) at a different position from the connector (15).

2 Claims, 6 Drawing Sheets

ANTENNA ELEMENT AND ANTENNA DEVICE

TECHNICAL FIELD

The present invention relates to an antenna technology, and more specifically to an antenna technology using a detachable external antenna.

BACKGROUND ART

Patent Literature 1 discloses one of antenna technologies using a detachable external antenna. An antenna device disclosed in Patent Literature 1 uses an earphone cable as an external antenna.

CITATION LIST

Patent Literature

Patent Literature 1
Japanese Patent Application Publication, Tokukai, No. 2008-92265 (Publication Date: Apr. 17, 2008)

SUMMARY OF INVENTION

Technical Problem

The antenna device disclosed in Patent Literature 1 can secure excellent antenna characteristics in a state where the earphone cable is engaged, but cannot receive a radio signal in a state where the earphone cable is not engaged, that is, in the absence of an antenna element.

The present invention is attained in view of the above problem. It is a main object of the present invention to provide a technology for securing excellent antenna characteristics even in a case where an external antenna is not engaged.

Solution to Problem

In order to solve the above problem, an antenna element in accordance with an aspect of the present invention includes: a feeding point; a connector in which an external antenna is detachably engaged; a first partial element connecting the feeding point and the connector; and a second partial element branching from the first partial element and having an open end at a different position from the connector.

Advantageous Effects of Invention

According to an aspect of the present invention, while the external antenna is not engaged, an electric current dominantly flows between the feeding point and the open end via the second partial element. Thus, it is possible to secure excellent antenna characteristics even in a case the external antenna is not engaged.

DESCRIPTION OF EMBODIMENTS

Figure 1:
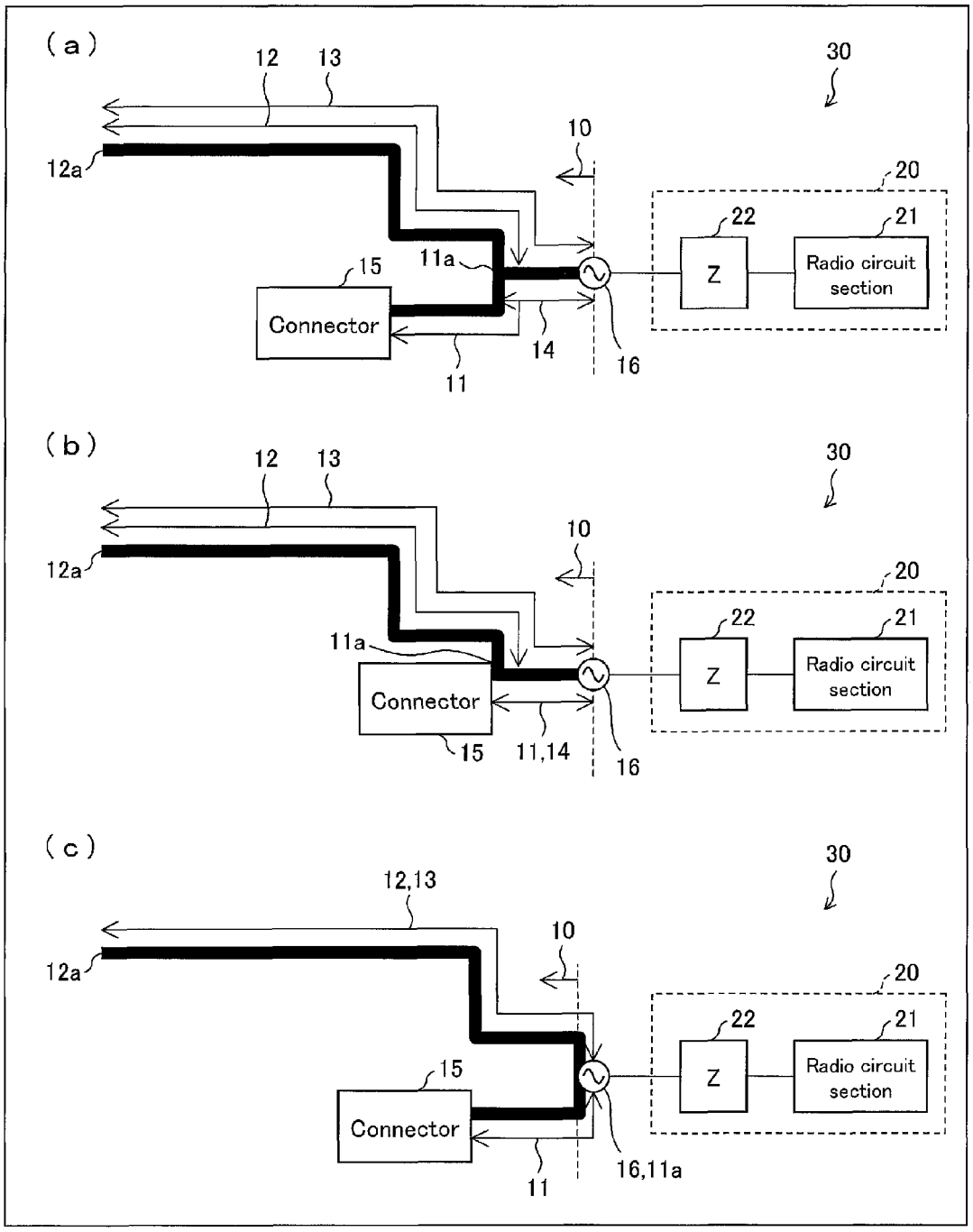
FIG. 1 is a view illustrating overviews of antenna elements in accordance with embodiments of the present invention.

Embodiments of the present invention will be described below with reference to the drawings. Note that members having the same function in the embodiments are given the same reference numerals.

(Basic Configuration)

FIG. 1 is a view illustrating overviews of antenna elements 10 in accordance with Embodiments 1 through 3 of the present invention. (a) of FIG. 1 illustrates the overview of the antenna element 10 in accordance with Embodiment 1, (b) of FIG. 1 illustrates the overview of the antenna element 10 in accordance with Embodiment 2, and (c) of FIG. 1 illustrates the overview of the antenna element 10 in accordance with Embodiment 3. Note that FIG. 1 illustrates the antenna element 10 being incorporated into an antenna device 30 and being connected to a circuit section 20 which is provided in the antenna device 30.

The antenna device 30 is not limited to any specific device, provided that it performs at least one of (i) transmission of radio signals and (ii) reception of radio signals via the antenna element 10. For example, the antenna device 30 can be applied to not only terminals such as mobile phone terminals (including smart phones), mobile information terminals (including tablet terminals) but also radio devices in general, such as image display devices capable of radio transmission and/or radio reception and audio output devices capable of radio transmission and/or radio reception.

The circuit section 20 includes a radio circuit section 21 and a matching circuit section 22, and transmits and receives a radio signal by feeding the antenna element 10. Note that the matching circuit section 22 can be provided as necessary or can be omitted. Further, the matching circuit section 22 is adjusted so as to have an optimum matching constant in a state in which any external antenna is not engaged. However, the arrangement of the matching circuit section 22 is not limited to such an arrangement. For example, the matching circuit section 22 can be arranged such that it detects engagement of the external antenna and then switches the matching so that the matching has the optimum matching constant in a state in which the external antenna is engaged, when the external antenna is engaged.

The antenna element 10 is constructed by a feeding point 16, a connector 15, and a plurality of partial elements (11 through 14). The antenna element 10 is placed in a fully off-ground area. Note that, the fully off-ground area does not mean a transmission line having characteristic impedance of, for example, 50Ω or 75Ω, but means an area where the antenna element 10 is placed at a distance, from the ground, enough to operate as a so-called radiating element.

The feeding point 16 is a part that is fed by the circuit section 20, and the feeding point 16 can be, for example, a junction of a feeding line extending from the circuit section 20. A method for connecting the feeding point 16 and the feeding line extending from the circuit section 20 is not limited to any specific method, provided that the feeding point 16 and the feeding line extending from the circuit section 20 are connected directly to each other or connected to each other in a high-frequency manner. For example, the connection may be made by, for example, pressing or soldering a plate spring, a gasket, or the like provided at the end of the feeding line to the feeding point 16. Alternatively, conductors may be faced in close proximity to each other and connected by a capacitor.

The connector 15 is configured such that the external antenna is detachably engaged in the connector 15. As described later, the connector 15 can be constructed as an earphone jack in a case where the external antenna is an earphone cable. Note, however, that the external antenna is not limited to the earphone cable, provided that the external antenna is an attachable/detachable antenna and that the connector 15 is connected directly to the external antenna or connected to the external antenna in a high-frequency manner.

The partial elements (11 through 14) are parts that constitute an antenna element and are not limited to any specific ones, provided that the partial elements are conductors constructed to be capable of emitting radio waves. The partial elements can be each, for example, a conductive pattern formed on a substrate, a conductive pattern formed on a flexible printed circuit board, a conductive pattern formed on a dielectric such as a resin by LDS (Laser Direct Structuring) method, an MID (Molded Interconnect Device), a DPA (Direct Printed Antenna), or the like. Alternatively, the partial elements may be a combination of any of the exemplified ones (For example, the conductive pattern formed on the substrate is provided in an area close to a feeding end, while the pattern formed by the LDS method is provided in the other area).

In each of the embodiments, the antenna element 10 includes: a first partial element 11 connecting the feeding point 16 and the connector 15; and a second partial element 12 branching at a branch point 11*a* from the first element 11 and having an open end 12*a* at a different position from the connector 15. Note that no switch is provided at the branch point 11*a*, and the first partial element 11 and the second partial element 12 are connected to the feeding point 16 regardless of an engagement state of the external antenna.

In Embodiment 1, the branch point 11 is provided at about a midpoint position of the first partial element 11 (see (a) of FIG. 1). The first partial element 11 constructs (i) a path from the branch point 11*a* to the connector 15 and (ii) a path from the branch point 11*a* to the feeding point 16. The second partial element 12 constructs a path from the branch point 11*a* to the open end 12*a*. Note that the path from the branch point 11*a* to the feeding point 16 can be referred to as a third partial element 14, and the path from the feeding point 16 to the open end 12*a* (in other words, a path formed by a combination of the second element 12 and the third element 14) can be referred to as a fourth partial element 13.

According to Embodiment 1, while the external antenna is engaged, an electric current dominantly flows through the external antenna and the first partial element 11, and it is therefore possible to secure antenna characteristics. While the external antenna is not engaged, an electric current dominantly flows through the second partial element 12 and the third partial element 14 (i.e. the fourth partial element 13), and it is therefore possible to secure antenna characteristics.

On the other hand, in a case where the second partial element 12 is absent, antenna characteristics can be degraded while the external antenna is not engaged. That is, in the absence of the second partial element 12, an electric current dominantly flows through the first partial element 11 which has an open end corresponding to the connector 15, while the external antenna is not engaged. In this case, the connector 15 can be located at a position that is unfavorable in serving as the open end of the antenna element (e.g. at a position around which a metallic component is present) because the connector 15 can be provided in a limited location in the antenna device in order to allow the external antenna to be detachably engaged in the connector 15. Particularly, in a case where the connector 15 is an earphone jack, a signal wire for audio signals approaches the open end of the first partial element 11. This causes degradation in antenna characteristics of the first partial element 11.

In contrast, according to Embodiment 1, the open end 12*a* is located at a different position from the connector 15, and the open end 12*a* is provided at a distance from the metallic component which is present around the connector 15. This facilitates an electric current flowing through the second partial element 12. Accordingly, while the external antenna is not engaged, an electric current dominantly flows between the feeding point 16 and the open end 12*a* via the second partial element 12. This allows the path connecting the feeding point 16 and the opening end 12*a* (i.e. the fourth partial element 13) to operate as a monopole antenna, and therefore makes it possible to prevent degradation in antenna characteristics. In particular, the open end 12*a*, unlike the connector 15, has a high degree of placement flexibility. Therefore, as compared to the connector 15, the open end 12*a* can be provided under conditions advantageous to an antenna, including a secure distance from a peripheral metallic component, and length, thickness, and the like appropriate for emission of radio waves. Accordingly, it is possible to attain more excellent antenna characteristics.

In Embodiment 2, the branch point 11*a* is provided at a connection part of the first partial element 11 at which part the first partial element 11 is connected to the connector 15 (see (b) of FIG. 1). The first partial element 11 constructs a path from the branch point 11*a* to the feeding point 16, and the second partial element 12 constructs a path from the branch point 11*a* to the open end 12*a*. Note that the path from the feeding point 16 to the branch point 11*a* (i.e. the first partial element 11) can be referred to as the third partial element 14, and the path from the feeding point 16 to the open end 12*a* (i.e. the path formed by a combination of the second partial element 12 and the first partial element 11) can be referred to as the fourth partial element 13.

According to Embodiment 2, as in Embodiment 1, while the external antenna is engaged, an electric current dominantly flows through the external antenna and the first partial element 11, and it is therefore possible to secure antenna characteristics. Further, as in Embodiment 1, the open end 12*a* is located at a different position from the connector 15, and the open end 12*a* is provided at a distance from the metallic component which is present around the connector 15. This facilitates an electric current flowing through the second partial element 12. Accordingly, while the external antenna is not engaged, an electric current dominantly flows through the second partial element 12 and the first partial element 11 (i.e. the fourth partial element 13), and it is therefore possible to secure antenna characteristics. Further, as in Embodiment 1, the opening end 12*a* has a high degree of placement flexibility, Therefore, the open end 12*a* can be provided under conditions advantageous to an antenna, including a secure distance from a peripheral metallic component, and length, thickness, and the like appropriate for emission of radio waves. Accordingly, it is possible to attain more excellent antenna characteristics.

In Embodiment 3, the first partial element 11 and the second partial element 12 are branched at the feeding point 16 (see (c) of FIG. 1). The first partial element 11 constructs a path from the feeding point 16 to the connector 15, and the second partial element 12 constructs a path from the feeding point 16 to the open end 12*a*. Note that the path from the feeding point 16 to the open end 12*a* can be referred to as the fourth partial element 13.

According to Embodiment 3, as in Embodiment 1, while the external antenna is engaged, an electric current dominantly flows through the external antenna and the first partial element 11, and it is therefore possible to secure antenna characteristics. Further, as in Embodiment 1, the open end 12*a* is located at a different position from the connector 15, and the open end 12*a* is provided at a distance from the metallic component which is present around the connector 15. This facilitates an electric current flowing through the second partial element 12. Accordingly, while the external antenna is not engaged, an electric current dominantly flows through the second partial element 12 (the fourth partial element 13), and it is therefore possible to secure antenna characteristics. Further, as in Embodiment 1, the opening end 12*a* has a high degree of placement flexibility, Therefore, the open end 12*a* can be provided under conditions advantageous to an antenna, including a secure distance from a peripheral metallic component, and length, thickness, and the like appropriate for radiation of radio waves. Accordingly, it is possible to attain more excellent antenna characteristics.

(Suitable Electrical Lengths of the Partial Elements]

In each of the embodiments, the partial elements are preferably arranged such that an electrical length of the fourth partial element 13 (a sum of a second electrical length L2, an electrical length of the second partial element 12, and an electrical length of the third partial element 14) is closer to a ¼ wavelength of an applied frequency of the antenna element 10 than to an electrical length of the first partial element 11 (first electrical length L1).

According to the arrangement as described above, while the external antenna is not engaged, an electrical length of the path from the open end 12*a* to the feeding point 16 (second electrical length L2) is closer to the ¼ wavelength of the applied frequency of the antenna element 10 than to an electrical length of the path from the connector 15 to the feeding point 16 (first electrical length L1). This generates a greater resonance in the path from the open end 12*a* and the feeding point 16 (fourth partial element 13) and allows a larger amount of electric current to flow over the path from the open end 12*a* to the feeding point 16 (fourth partial element 13). This makes it possible to further improve antenna characteristics.

Especially, the electrical length of the fourth partial element 13 (second electrical length L2) is preferably not less than a ⅛ wavelength of the applied frequency of the antenna element 10 but not more than a ⅜ wavelength of the applied frequency of the antenna element 10, and is further preferably approximately a ¼ wavelength of the applied frequency of the antenna element 10. With such an arrangement, the fourth partial element 13 suitably operates as a monopole antenna.

Further, the partial elements are preferably arranged such that an electrical length of the third partial element 14 (third electrical length L3) is longer than one fourth of the second electrical length L2, or that the electrical length of the third partial element 14 (third electrical length L3) is longer than whichever shorter one of (i) one fourth of the second electrical length L2 or (ii) a 1/16 wavelength of the applied frequency of the antenna element 10 (In other words, the third electrical length L3 is preferably longer than whichever shorter one of (i) one fourth of the second electrical length L2 or (ii) the 1/16 wavelength of the applied frequency of the antenna element 10.).

With such an arrangement, while the external antenna is engaged, an electric current is hard to flow through the second partial element 12 (resonance is hard to occur in the second partial element 12), and a larger amount of electric current flows through the external antenna. This makes it possible to further improve antenna characteristics.

More specifically, an electrical length of the second partial element 12 (fourth electrical length L4) is determined by subtracting the electrical length of the third partial element 14 (third electrical length L3) from the electrical length of the fourth partial element 13 (second electrical length L2). With an arrangement in which the second electrical length L2 is closer to the ¼ wavelength of the applied frequency of the antenna element 10, and the third electrical length L3 is longer than one fourth of the second electrical length L2 or longer than the 1/16 wavelength of the applied frequency of the antenna element 10, the electrical length of the second partial element 12 (fourth electrical length L4) becomes sufficiently shorter than the ¼ wavelength of the applied frequency of the antenna element 10 (for example, in a case where the second electrical length L2 is the ¼ wavelength of the applied frequency of the antenna element 10, the fourth electrical length L4 becomes not more than a 3/16 wavelength of the applied frequency). Therefore, resonance in the second partial element 12 occurs at a frequency falling outside a band of the applied frequency (at a frequency higher than the applied frequency). With this arrangement, while the external antenna is engaged, an electric current is hard to flow through the second partial element 12, and a larger amount of electric current flows through the external antenna. This makes it possible to further improve antenna characteristics.

Note that the above-described conditions are not satisfied in Embodiment 3. This is because, in Embodiment, the third partial element 14 is absent, and the third electrical length L3 is therefore taken as 0.

[Embodiment in which the Connector 15 Serves as an Earphone Jack]

Next, more detailed embodiments will be described below. In Embodiments 4 through 6, the antenna devices 30 in Embodiments 1 through 3 respectively are arranged such that each of the antenna devices 30 is a mobile phone terminal having a function of receiving a digital television broadcast (one-segment broadcast or full-segment broadcast), and that each of the connectors 15 is an earphone jack for allowing an external antenna (earphone cable) 40 detachably engaged therein. The other arrangements in Embodiment 4, 5, and 6 are similar to those in Embodiment 1, 2, and 3, respectively.

In the above arrangement, the earphone cable is used as the external antenna 40, and the earphone jack is used as the connector 15. This arrangement eliminates the need to separately provide another connector 15 for allowing the external antenna to be engaged in that connector 15. Further, any earphone can be used as the external antenna 40.

Further, in Embodiments 4 through 6, the antenna element 10 is an antenna for receiving a digital television broadcast. It is considered that a user often views a digital television broadcast with the external antenna (earphone cable) 40 engaged in the connector 15. Therefore, by using the external antenna (the earphone cable) 40 as an antenna for receiving a digital television broadcast, it is possible to suitably receive a digital television broadcast in order for the user to view the digital television broadcast.

Figure 2:
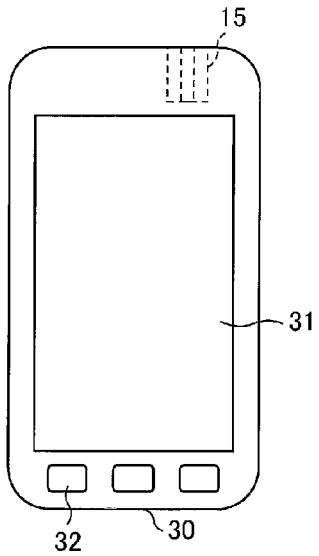
FIG. 2 is a view illustrating an appearance of a front side of a mobile phone terminal in accordance with embodiments of the present invention.

FIG. 2 is a view illustrating an appearance of a front side of the antenna device (mobile phone terminal) 30 in accordance with Embodiments 4 through 6. FIG. 2 illustrates a state where the external antenna (earphone cable) 40 is not engaged. As illustrated in FIG. 2, the connector (earphone jack) 15 is provided on a right end of a top end part of the antenna device 30 when viewed from the front. Further, a liquid crystal panel 31 is provided in a central part of the antenna device 30. Further, an operation button 32 is arranged in the lower end part of the antenna device 30.

Figure 3:
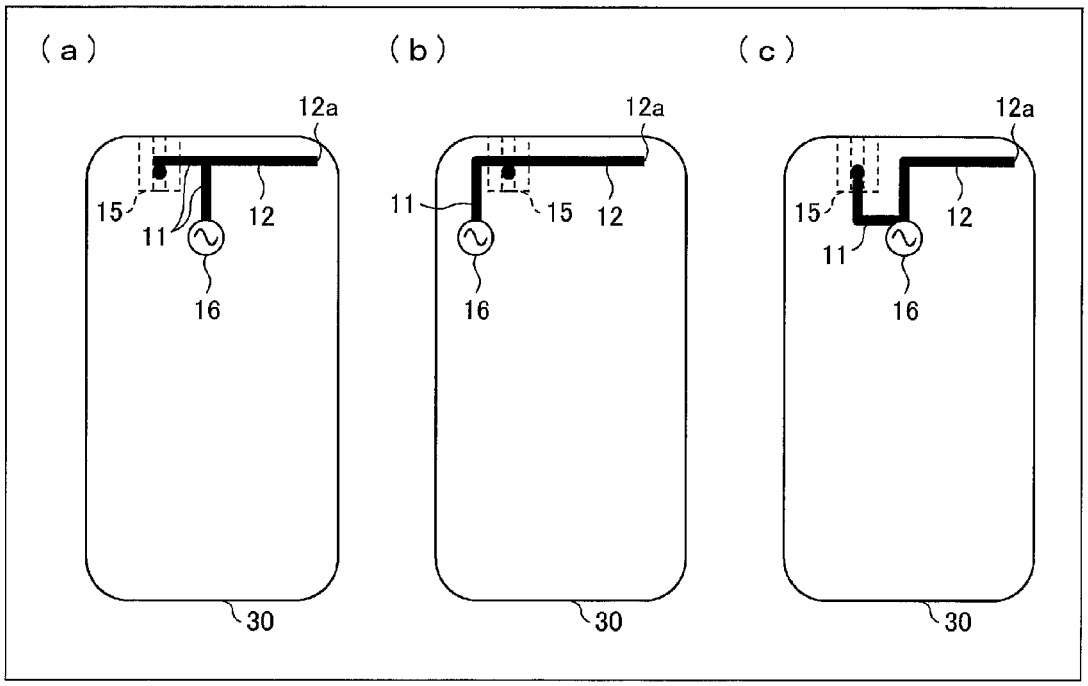
FIG. 3 is views each illustrating an appearance of a back side of a mobile phone terminal (from which a battery cover is being removed) in accordance with embodiments of the present invention, in a state where an external antenna is not engaged.

FIG. 3 is views each illustrating an appearance of a back side of the antenna device (mobile phone terminal) 30 in accordance with Embodiments 4 through 6. (a) of FIG. 3 illustrates an appearance of a back side of the antenna device 30 in accordance with Embodiment 4, (b) of FIG. 3 illustrates an appearance of a back side of the antenna device 30 in accordance with Embodiment 5, and (c) of FIG. 3 illustrates an appearance of a back side of the antenna device 30 in accordance with Embodiment 6. FIG. 3 illustrates a state where the external antenna (earphone cable) 40 is not engaged. FIG. 3 also illustrates a state where a battery cover (not shown) to be placed on the rearmost back face of the antenna device 30 (mobile phone terminal) 30 is removed so that the antenna element 10 is exposed to view.

As illustrated in FIG. 3, in Embodiments 4 through 6, the antenna element 10 is provided on a back-side surface of a housing of the antenna device (mobile phone terminal) 30. Further, a part where the feeding point 16 of the antenna element 10 is provided passes through the housing. The antenna element 10 is fed by the circuit section 20 via a spring, a gasket or the like, inside the housing.

In Embodiment 4, the open end 12*a* is provided at a different position from the connector 15. In other words, the open end 12*a* is provided apart from, for example, a signal wire for audio signals which signal wire is provided in the connector 15. With this arrangement, an electric current dominantly flows over a path connecting the feeding point 16 and the open end 12*a*, via the second partial element 12 and a part of the first partial element 11 (see (a) of FIG. 3). Similarly, in Embodiment 5, the open end 12*a* is provided at a different position from the connector 15, so that an electric current dominantly flows over the path connecting the feeding point 16 and the open end 12*a*, via the first partial element 11 and the second partial element 12 (see (b) of FIG. 3). In Embodiment 6, the open end 12*a* is provided at a different position from the connector 15, and an electric current dominantly flows over the path connecting the feeding point 16 and the open end 12*a*, via the second partial element 12 (see (c) of FIG. 3).

Figure 4:
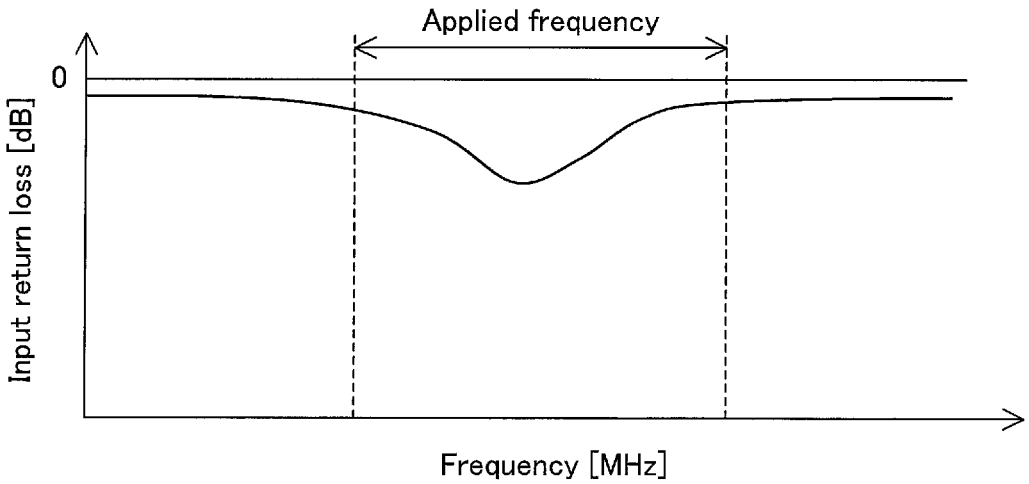
FIG. 4 is a graph showing an example return loss in embodiments of the present invention, in a case where an external antenna is not engaged.

Accordingly, as illustrated in FIG. 4, it is possible to obtain a suitable return loss at an applied frequency. Note that, FIG. 4 is a graph showing an example return loss of the antenna element 10 in a case where the external antenna (earphone cable) 40 is not engaged, in Embodiments 4 through 6.

Figure 5:
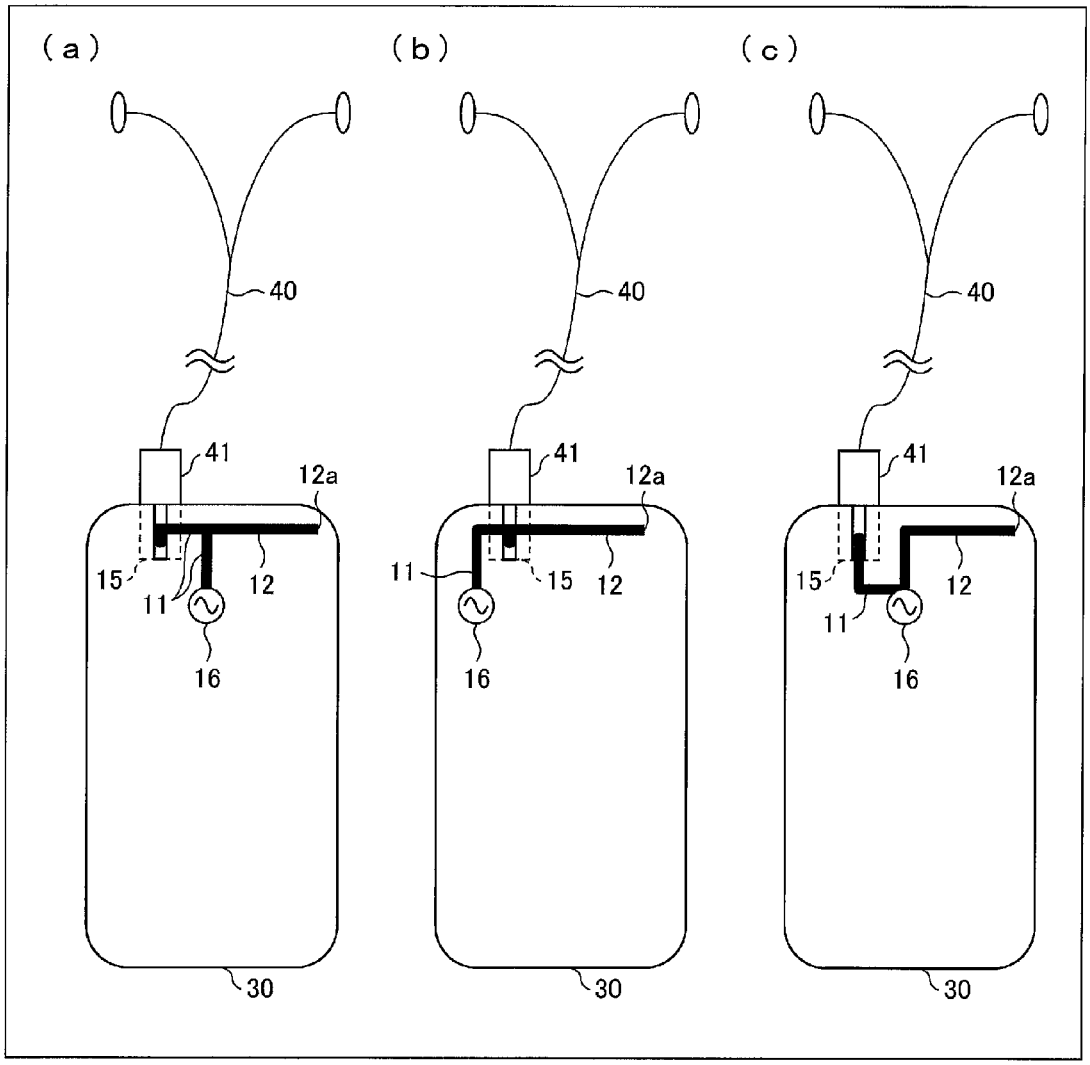
FIG. 5 is views each illustrating an appearance of a back side of a mobile phone terminal (from which a battery cover is being removed) in accordance with embodiments of the present invention, in a state where an external antenna is engaged.

FIG. 5 is a view illustrating an appearance of a back side of the antenna device (mobile phone terminal) 30 in accordance with Embodiments 4 through 6. FIG. 5 illustrates a state where the external antenna (earphone cable) 40 is engaged (a state where an earphone plug 41 is inserted into the connector (earphone jack) 15). Further, similarly to FIG. 3, FIG. 5 illustrates a state where the battery cover (not shown) to be placed in the rearmost back face of the antenna device (mobile phone terminal) 30 is removed so that the antenna element 10 is exposed to view.

In Embodiment 4, as shown in (a) of FIG. 5, the external antenna (earphone cable) 40 is connected to the feeding point 16 via the earphone plug 41, the connector (earphone jack) 15, and the first partial element 11. In this arrangement, the external antenna (earphone cable) 40 is provided apart from a metallic component of the antenna device (mobile phone terminal) 30. This facilitates an electric current to flow through the external antenna (earphone cable) 40. Accordingly, an electric current hardly flows through the second partial element 12, but dominantly flows through the external antenna (earphone cable) 40. Similarly, in Embodiment 5, the external antenna (earphone cable) 40 is connected to the feeding point 16 via the earphone plug 41, the connector (earphone jack) 15, and the first partial element 11, so that an electric current dominantly flows through the external antenna (earphone cable) 40 (see (b) of FIG. 5). Similarly, in Embodiment 6, the external antenna (the earphone cable) 40 is connected to the feeding point 16 via the earphone plug 41, the connector (earphone jack) 15, and the first partial element 11, so that an electric current dominantly flows through the external antenna (earphone cable) 40 (see (c) of FIG. 5).

Figure 6:
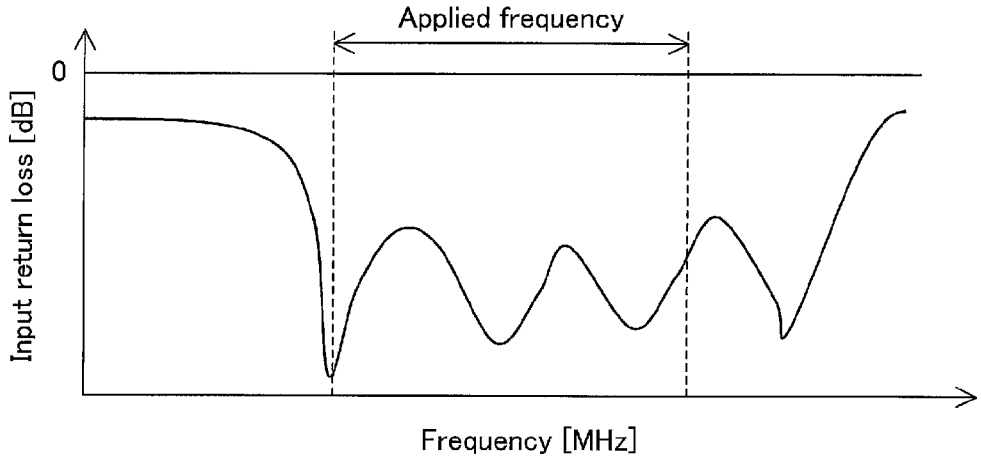
FIG. 6 is a graph showing an example return loss in embodiments of the present invention, in a case where an external antenna is engaged.

Accordingly, as illustrated in FIG. 6, it is possible to obtain a highly suitable return loss at an applied frequency. Note that, FIG. 6 is a graph showing an example of return loss of the antenna element 10 in Embodiments 4 through 6, in a case where the external antenna (earphone cable) 40 is engaged.

Note that, the external antenna (earphone cable) 40 is not limited to any specific antenna and can be any antenna irrespective of, for example, length and type. From one viewpoint, however, the electrical length of the external antenna (earphone cable) 40 is more preferably such that the electrical length of the external antenna 40 is sufficiently longer than the fourth partial element 13. In addition, the electrical length of the external antenna (earphone cable) 40 is further preferably not less than a ⅜ wavelength of an applied frequency of the antenna element 10, and particularly preferably not less than a ½ wavelength of the applied frequency. Using the external antenna (the earphone cable) 40 sufficiently longer in electrical length than the fourth partial element 13 generates no resonance of a ¼ wavelength system. This makes it possible to reduce an effect caused while the external antenna (earphone cable) 40 is attached to a human body (ears).

Figure 7:
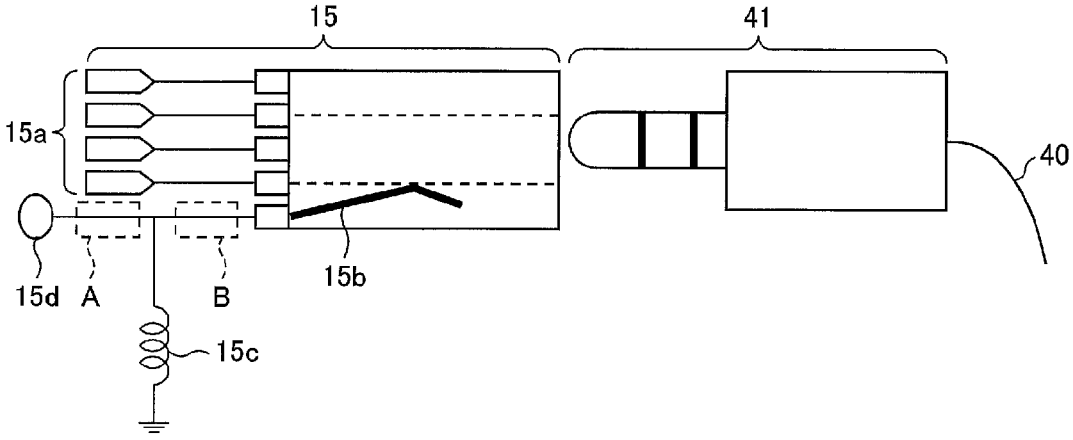
FIG. 7 is a view illustrating an example main configuration of a connector in accordance to embodiments of the present invention.

FIG. 7 is a view illustrating an example main configuration of the connector (earphone jack) 15 in Embodiments 4 through 6. With reference to FIG. 7, the description below deals with an arrangement in which an external conductor (ground wire) of the earphone cable is used as an antenna. The present invention, however, is not limited to such an arrangement. Alternatively, a signal wire for audio signals or the like of the earphone cable can be used as an antenna.

As shown in FIG. 7, the connector (earphone jack) 15 includes: a signal wire 15*a* connecting to a signal wire for sound, microphone input, and the like of the external antenna (earphone cable) 40; and a ground terminal 15*b* for connecting to the external conductor (ground wire).

The ground terminal 15*b* has branches. One branch of the ground terminal 15*b* is connected to the ground of the antenna device (mobile phone terminal) 30, and the other branch is connected to the first partial element 11 via a connecting part 15*d* such as a gasket. A filter 15*c* is provided between the ground terminal 15*b* and the ground and between the connecting part 15*d* and the ground.

When the earphone plug 41 is inserted into the connector (earphone jack) 15, the external conductor (ground wire) of the external antenna (earphone cable) 40 is connected to the first partial element 11 via the ground terminal 15*b* and the connecting part 15*d*, so that the external conductor (ground wire) of the external antenna (earphone cable) 40 can be used as an antenna.

Note that the filter 15*c* is constructed by, for example, a choke coil and is arranged to interrupt (release) an electric current of an applied frequency of the antenna element 10 in a high-frequency manner. Accordingly, it is possible to interrupt (release) between the ground of the antenna device (mobile phone terminal) 30 and the first partial element 11 in a high-frequency manner. Therefore, it is possible (i) to avoid a high-frequency connection between the feeding point 16 and the ground of the antenna device (mobile phone terminal) 30, and (ii) to successfully use the external conductor (ground wire) of the external antenna (earphone cable) as an antenna.

Similarly, in a case where a signal wire of the external antenna (earphone cable) 40, such as a signal wire for audio signals, is to be used as an antenna, the connecting part 15*d* connecting to the first partial element 11 is electrically connected to any one of the signal wires 15*a* which one is intended to be used as the antenna, and the filter 15*c*, which is arranged so as to interrupt (release) an electric current of the applied frequency of the antenna element 10 in a high-frequency manner, is placed at a position closer to the circuit than to the connecting point between the signal wire 15*a* and the connecting part 15*d* (at a position opposite the connector 15). Such an arrangement allows an existing signal wire, a ground wire, or the like to be used as an antenna, while eliminating a dedicated antenna wire.

In the above-described arrangement, a ground wire, a signal wire for audio signals or the like signal which signals are used in the external antenna (earphone cable) 40 are individually used as an antenna. The present invention is not limited to such an arrangement. Alternatively, a ground wire and a signal wire for audio signals or the like signals can be tied in a bundle to be used as an antenna. Further alternatively, only a plurality of signal wires for audio signals or the like signals can be tied in a bundle to be used as an antenna.

(Comparison with Another Configuration]

Figure 8:
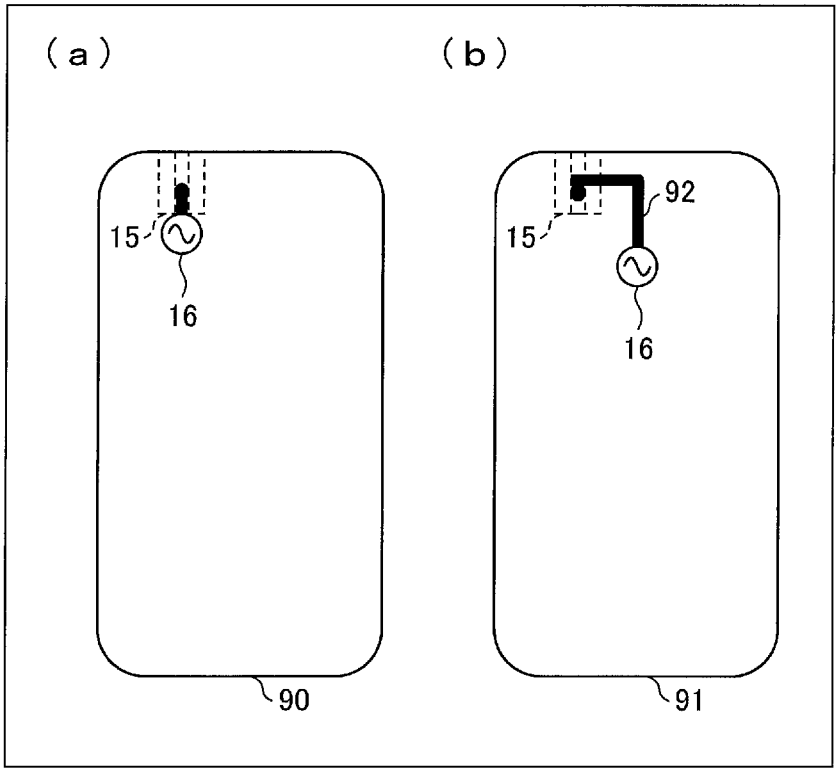
FIG. 8 is a view illustrating an antenna device configured differently from an antenna device of the present invention.

Another antenna device configured differently from the antenna device of the present invention will be described below in comparison with the antenna device 30 in accordance with the foregoing embodiments. FIG. 8 is a view illustrating an antenna device configured differently from the antenna device of the present invention.

In an antenna device 90 illustrated in (a) of FIG. 8, connection between the feeding point 16 and the connector 15 is made without any intermediate antenna element, as in the technique disclosed in Patent Literature 1.

Such an arrangement brings about excellent antenna characteristics in a case where the external antenna 40 is engaged. However, in a case where the external antenna 40 is not engaged, anything that can operate as an antenna does not exist. This disables transmission and reception.

In an antenna device 91 illustrated in (b) of FIG. 8, the feeding point 16 and the connector 15 are connected to each other via an element 92. Further, the feeding point 16 and the connector 15 are connected to both ends of the element 92.

Such an arrangement brings about excellent antenna characteristics in a case where the external antenna 40 is engaged. However, in a case where the external antenna 40 is not engaged, the open end of the element 92 corresponds to the connector 15. Therefore, the open end approaches a metallic component, such as a signal wire for audio signals, provided in the connector 15. Thus, it is difficult to secure excellent antenna characteristics.

In contrast, the antenna device 30 in accordance with the foregoing embodiment can secure excellent antenna characteristics even in a case where the external antenna 40 is not engaged.

[Recap]

An antenna element 10 in accordance with Aspect 1 of the present invention includes: a feeding point 16; a connector 15 in which an external antenna 40 is detachably engaged; a first partial element 11 connecting the feeding point 16 and the connector 15; and a second partial element 12 branching from the first partial element 11 and having an open end 12*a* at a different position from the connector 15.

According to the above arrangement, while the external antenna 40 is not engaged, an electric current dominantly flows between the feeding point 16 and the open end 12*a* via the second partial element 12. This makes it possible to secure antenna characteristics.

On the other hand, in a case where the second partial element 12 is absent, antenna characteristics can be degraded while the external antenna 40 is not engaged. That is, in the absence of the second partial element 12, an electric current dominantly flows through the first partial element 11 whose open end corresponds to the connector 15, while the external antenna is not engaged. In this case, the connector 15 can be located at a position that is unfavorable in serving as the open end of the antenna element (e.g. at a position around which a metallic component is present) because an available location of the connector 15 can be provided in a limited location in the antenna device in order to allow the external antenna to be engaged in the connector 15 detachably. Particularly in a case where the connector 15 is an earphone jack, a signal wire for audio signals approaches the open end of the first partial element 11. This causes degradation in antenna characteristics of the first partial element 11.

In contrast, according to the above arrangement, the open end 12*a* is located at a different position from the connector 15, and the open end 12*a* is provided at a distance from the metallic component which is present around the connector 15. This facilitates an electric current flowing through the second partial element 12. Accordingly, while the external antenna 40 is not engaged, an electric current dominantly flows between the feeding point 16 and the open end 12*a* via the second partial element 12. This allows the path connecting the feeding point 16 and the open end 12*a* to operate as a monopole antenna, and therefore makes it possible to prevent degradation in antenna characteristics.

As described above, the above arrangement makes it possible to secure excellent antenna characteristics even in a case where the external antenna 40 is not engaged.

The antenna element 10 in accordance with Aspect 2 of the present invention is preferably arranged in Aspect 1 such that a second electrical length L2 from the feeding point 16 to the open end 12*a* is closer to a ¼ wavelength of an applied frequency of the antenna element 10 than a first electrical length L1 from the feeding point 16 to the connector 15 is.

According to the above arrangement, a greater resonance is generated over the path from the open end 12*a* to the feeding point 16 via the second partial element 12, and a larger amount of electric current flows over the path from the open end 12*a* to the feeding point 16. Therefore, it is possible to further improve antenna characteristics.

The antenna element 10 in accordance with Aspect 3 of the present invention is preferably arranged in Aspect 2 such that a third electrical length L3 from the feeding point 16 to a branch point 11*a* at which and the second partial element 12 is branched from the first partial element 11 is longer than whichever shorter one of (i) one fourth of the second electrical length L2 or (ii) a 1/16 wavelength of the applied frequency of the antenna element 10.

According to the above arrangement, the electrical length of the second partial element 12 is sufficiently shorter than the ¼ wavelength of the applied frequency of the antenna element 10. This causes the second partial element 12 to resonate at a frequency falling outside a band of the applied frequency (at a frequency higher than the applied frequency). With this arrangement, while the external antenna is engaged, an electrical current is hard to flow through the second partial element 12, and a larger amount of electric current flows through the external antenna. This makes it possible to further improve antenna characteristics.

The antenna element 10 in accordance with Aspect 4 of the present invention can be arranged in Aspects 1 through 3 such that the external antenna 40 is an earphone cable while the connector 15 is an earphone jack.

According to the above arrangement, the earphone cable is used as the external antenna 40, while the earphone jack is used as the connector 15. This arrangement eliminates the need to separately provide another connector 15 for allowing the external antenna to be engaged in that connector 15.

The antenna device 30 in accordance with Aspect 5 of the present invention is provided with the antenna element 10 of Embodiments 1 through 4 described earlier.

According to the above arrangement, the antenna device 30 can secure excellent antenna characteristics even in a case where the external antenna 40 is not engaged.

The antenna device 30 in accordance with Aspect 6 of the present invention may be arranged in Aspect 5 such that the antenna device 30 includes a metallic component (such as signal wires 15*a*), wherein the open end 12*a* is provided farther from the metallic component than the connector 15 is.

According to the above arrangement, it is possible to secure more excellent antenna characteristics in a case where the external antenna 40 is not engaged.

The present invention is not limited to the descriptions of the embodiments, but can be altered by a person skilled in the art within the scope of the claims. An embodiment derived from a proper combination of technical means disclosed in different embodiments is also encompassed in the technical scope of the present invention. Moreover, a novel technical feature can be created by a combination of technical means disclosed in these embodiments.

INDUSTRIAL APPLICABILITY

The present invention is applicable to radio devices in general.

REFERENCE SIGNS LIST

10 Antenna element
11 First partial element
11*a* Branch point
12 Second partial element
12*a* Open end
13 Fourth partial element
14 Third partial element
15 Connector
15*a* Signal wire
15*b* Ground terminal
15*c* Filter
15*d* Connecting part
16 Feeding point
20 Circuit section
21 Radio circuit section
22 Matching circuit section
30 Antenna device
40 External antenna

The invention claimed is:

1. An antenna apparatus comprising:
an internal radiator;
a feeding point at which the internal radiator is connected to a radio circuit; and
a connector which detachably connects the internal radiator to an external radiator; wherein
the internal radiator includes a first linear element connecting the feeding point and the connector; and a second linear element branching from one of an end of the first linear element that is connected to the feeding point, an end of the first linear element that is connected at the connector, and a middle of the first linear element between the feeding point and the connector,
the second linear element includes an open end at a different position from the connector,
a second electrical length from the feeding point to the open end is closer to a ¼ wavelength of an applied frequency of the antenna apparatus than a first electrical length from the feeding point to the connector,
the first linear element and the second linear element are in a housing that includes the radio circuit,
the external radiator is an earphone cable and the connector is an earphone jack, and
the antenna apparatus alters antenna current flow in the internal radiator based on a connected state or an unconnected state of the internal radiator and the external radiator.

2. The antenna apparatus as set forth in claim 1, wherein a third electrical length from the feeding point to a branch point at which the second linear element is branched from the first linear element is longer than whichever shorter one of (i) one fourth of the second electrical length or (ii) a 1/16 wavelength of the applied frequency of the antenna apparatus.

* * * * *